US005193275A

United States Patent [19]

Hirokazu et al.

[11] Patent Number: 5,193,275

[45] Date of Patent: Mar. 16, 1993

[54] FLAT-SHAPED DRY SHAVER

[75] Inventors: Kato Hirokazu; Yoshinobu Sakamura, both of Hikone, Japan

[73] Assignee: Matsushita Electric Works, Ltd., Osaka, Japan

[21] Appl. No.: 896,785

[22] Filed: Jun. 9, 1992

Related U.S. Application Data

[63] Continuation of Ser. No. 745,743, Aug. 16, 1991, abandoned.

[30] Foreign Application Priority Data

Aug. 28, 1990 [JP] Japan ..... 2-227331

[51] Int. Cl.[5] ..... B26B 19/20; B26B 19/12; B26B 19/00; B26B 19/02

[52] U.S. Cl. ..... 30/43; 30/43.9; 30/43.91; 30/43.92

[58] Field of Search ..... 30/43, 43.1, 43.6, 43.9, 30/43.91, 43.92

[56] References Cited

U.S. PATENT DOCUMENTS

| | | | |
|---|---|---|---|
| 2,198,833 | 4/1940 | Muros | 30/43.9 |
| 3,279,056 | 10/1966 | Andis | 30/43.1 |
| 3,447,058 | 5/1969 | Stahly et al. | 30/43.9 |
| 3,813,774 | 6/1974 | Cobarg | 30/43.9 |
| 3,842,498 | 10/1974 | Mizobata et al. | 30/43.92 |
| 4,428,117 | 1/1984 | Horii et al. | 30/43.91 |
| 4,660,283 | 4/1987 | Yasunaka | 30/43.92 |
| 4,675,997 | 6/1987 | Nakagawa et al. | 30/43 |
| 4,719,698 | 1/1988 | Ninomiya et al. . | |
| 4,751,781 | 6/1988 | Szymansky et al. | 30/43.92 |
| 4,845,847 | 7/1989 | Yasunaka et al. | 30/43.92 |
| 4,918,819 | 4/1990 | Labrijn | 30/43 |
| 4,941,259 | 7/1990 | Wolf | 30/43.92 |

FOREIGN PATENT DOCUMENTS

| | | |
|---|---|---|
| 7413938 | 8/1974 | Fed. Rep. of Germany . |
| 3430561 | 2/1986 | Fed. Rep. of Germany . |
| 53-93957 | 8/1978 | Japan . |
| 54-056565 | 5/1979 | Japan . |
| 54-485865 | 7/1979 | Japan . |
| 150060 | 4/1984 | Japan . |
| 0150060 | 10/1989 | Japan . |

*Primary Examiner*—Douglas D. Watts
*Assistant Examiner*—Paul M. Heyrana
*Attorney, Agent, or Firm*—Stevens, Davis, Miller & Mosher

[57] ABSTRACT

A dry shaver has a flat casing mounting a flat cutter head composed of an outer shear foil and an inner cutter assembly. The inner cutter assembly is driven by a flat motor accommodated within the casing to reciprocate in hair shearing engagement with the outer shear foil. A flat and elongated battery is disposed within the casing over substantially the entire length thereof in side-by-side relation to the flat motor. The motor has a length shorter than the battery and is disposed in the casing with its lower end in substantially the same level as that of the battery so as to define above the motor a space which extends into an upper center portion from one lateral side of the casing. The flat motor has an output rotor shaft extending upwardly into the space for coupling thereat to an output rotor shaft. Pivotally supported to an upper center portion of the casing is a pivot lever which has a first end extending upwardly of the casing for coupling with the inner cutter assembly and has a second end extending downwardly into a lower portion of the space for coupling with a drive arm. The drive arm extends horizontally from the eccentric shaft to the second end of the pivot lever within the space in order to reciprocate the pivot lever about a pivot axis upon rotation of the eccentric shaft, thereby driving to reciprocate the inner cutter assembly.

17 Claims, 7 Drawing Sheets

40
42
41
34
33
32
35
43
43
64
21
36
31
63
60
61
66
62
65
68
70
71
56
55
72
80
91
96
93
51
50
23
112
92
25
100
97
111
98
121
28
24
101
120
26
102
100
103
103
105
27

FLAT-SHAPED DRY SHAVER

This application is a Continuation of application Ser. No. 07/745,743, filed Aug. 16, 1991, now abandoned.

BACKGROUND OF THE INVENTION

1. Field of the Invention

The present invention is directed to a flat-shaped dry battery, and more particularly to a battery-powered small dry shaver of a reciprocatory type.

2. Description of the Prior Art

There have been provided a number of reciprocatory dry shavers designed into a compact configuration taking advantage of present-day technologies of miniaturizing a motor and a battery. A typical prior art shaver of compact configuration is disclosed in Japanese Examined Patent Publication [KOKOKU] No. 1-50060. In this patent, the battery and the motor are accommodated within a housing in side-by-side relation to each other so as to reduce a width dimension. The motor is operatively coupled to a rotary-to-reciprocation translator which translates a rotary motion of an eccentric pin coupled to a motor output shaft into a reciprocatory motion of an inner cutter assembly. The translator is movably supported within the housing by a pair of resilient legs integrally extending from the opposite ends of the translator and bent upwardly for supporting connection to the lateral ends of the housing. Due to the structural limitation of the translator, the housing is required to have an enough space extending laterally over the battery and the motor for accommodating the translator. This space adds a length or height dimension to the housing because of that the resilient legs are required to a certain length for giving a sufficient reciprocatory stroke to the translator. Thus, the prior art dry shaver is insufficient to minimizing the length or height dimension. Further, the miniature battery is limited to a cylindrical battery of which diameter is still greater than a minimum thickness available for the cutter head as well as for the motor. Therefore, the prior art dry shaver is also insufficient for reducing the thickness to a minimum.

SUMMARY OF THE INVENTION

The present invention has been accomplished to eliminate the above insufficiencies and to provide a compact-size reciprocatory dry shaver with minimum length, width, and thickness. The dry shaver in accordance with the present invention includes a flat casing mounting a flat cutter head composed of an outer shear foil and an inner cutter assembly driven by an incorporated motor to reciprocate in hair shearing engagement with the outer shear foil. The motor is energized by a flat and elongated battery which is disposed within the casing to extend along one lateral side over the substantially the entire length of the casing. The motor is also of a flat configuration and disposed within the casing in side-by-side relation to the battery to extend along the other lateral side of the casing, thus determining a width dimension substantially as an added width of the battery and the motor. The motor, which is disposed with its lower end substantially in line with that of the battery, has a length shorter than the battery to thereby define thereabove a space which extends laterally into an upper center portion of the casing in an immediately adjacent relation to the battery. The flat motor has an output rotor shaft extending upwardly into thus defined space for coupling with an eccentric shaft located within the space. Supported to an upper center portion of the casing is a pivot lever which has a first end extending upwardly of the casing for coupling with the inner cutter assembly and has a second end extending downwardly into a lower portion of the space for coupling with a drive arm extending horizontally from the eccentric shaft within the space. The drive arm is coupled to the second arm in such a manner as to translate the eccentric rotary motion of the eccentric pin into the reciprocatory motion of the second arm, thereby oscillating the pivot lever about a pivot axis to reciprocate the first arm and the inner cutter assembly connected thereto. Thus, the casing can be designed to have a reduced length determined substantially solely by the length of the battery and without adding an extra length dimension to the casing for accommodating the driving mechanism for reciprocating the inner cutter assembly by the motor. Also with the use of the flat battery of which thickness is less than the thickness to which the cutter head and the motor can be reduced, the thickness of the casing can be reduced to a minimum determined solely by a larger one of the cutter head and the motor without considering the battery thickness. Thus, the casing can be successfully compacted to minimum width, length and thickness substantially determined, respectively by the added width of the motor and the battery, battery length, and the thickness of the larger one of the cutter head and the motor.

Accordingly, it is a primary object of the present invention to provide a battery powered reciprocatory dry shaver which is capable of being compacted with respect to the width, length, and thickness.

In a preferred embodiment, the motor is selected to have a thickness which is substantially equal to that of the cutter head and is greater than that of the battery. The casing comprises a housing and a sheath intimately fitted over the housing. The housing is composed of a pair of housing halves between which the battery is sandwiched. The housing halves are formed respectively with opposed openings which are cooperative to form a through hole for receiving therein the entire thickness of the motor. Whereby, the housing can be reduced in thickness to a minimum substantially equal to that of the motor and the cutter head.

It is therefore another object of the present invention to provide a battery powered reciprocatory dry shaver in which the casing can be reduced to a minimum thickness substantially equal to that of the motor.

The housing includes a terminal spring having a contact end for electrical connection to one electrode of the battery. The terminal spring is formed integrally with a spring leg which is disposed on the interior surface of one of the housing halves for urging the battery against the interior surface of the other housing half. In other words, the terminal spring can be formed into a unitary structure including the spring leg required to positively hold the battery within the housing, reducing the number of parts utilized in the dry shaver, which is therefore a further object of the present invention.

The dry shaver includes a head cap to be fitted over the cutter head. The head cap is also of flat configuration so as to be in continuous or flush with the sheath of the housing when fitted over the cutter head. The head cap and the casing are so dimensioned that the head cap is cooperative with the casing to give a credit card size planar configuration to the dry shaver, while maintaining a reduced thickness. Consequently, the dry shaver of the present can be readily carried in the individual's pocket or the like limited space so as to be sufficiently portable, which is therefore a still further object of the present invention.

Preferably, the drive arm is formed at an end opposite of the eccentric pin with a socket for coupling with a ball at the lower end of the second arm of the pivot lever, providing a ball-joint between the pivot lever and the drive arm for smoothly and efficiently translating the eccentric rotary motion of the eccentric pin into an oscillatory motion of the pivot lever.

These and still other objects and advantages will become more apparent from the following description of the preferred embodiment of the present invention when taken in conjunction with the attached drawings.

BRIEF DESCRIPTION OF THE DRAWINGS

FIG. 11 is a cross section taken along line 12—12 of FIG. 11.

DETAILED DESCRIPTION OF THE EMBODIMENT

Figure 1:
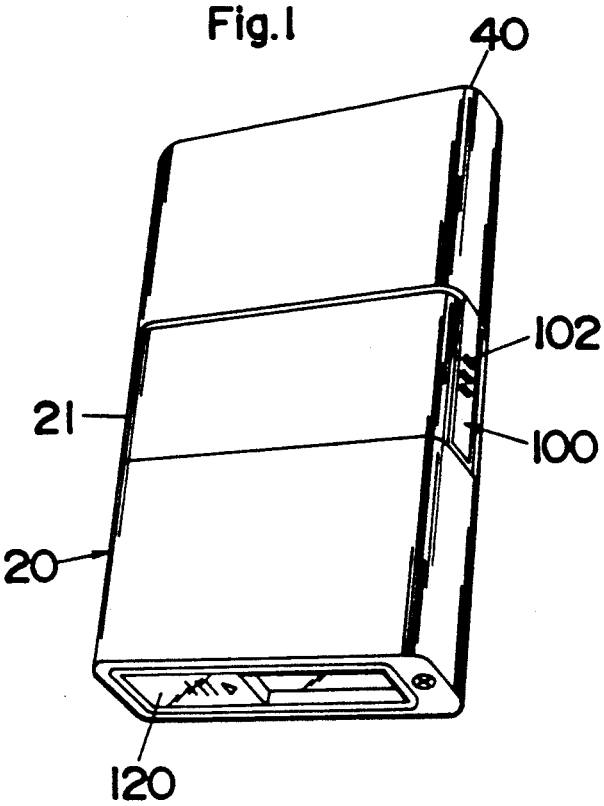
FIG. 1 is a perspective view of a flat reciprocatory dry shaver in accordance with a preferred embodiment of the present invention.
Figure 2:
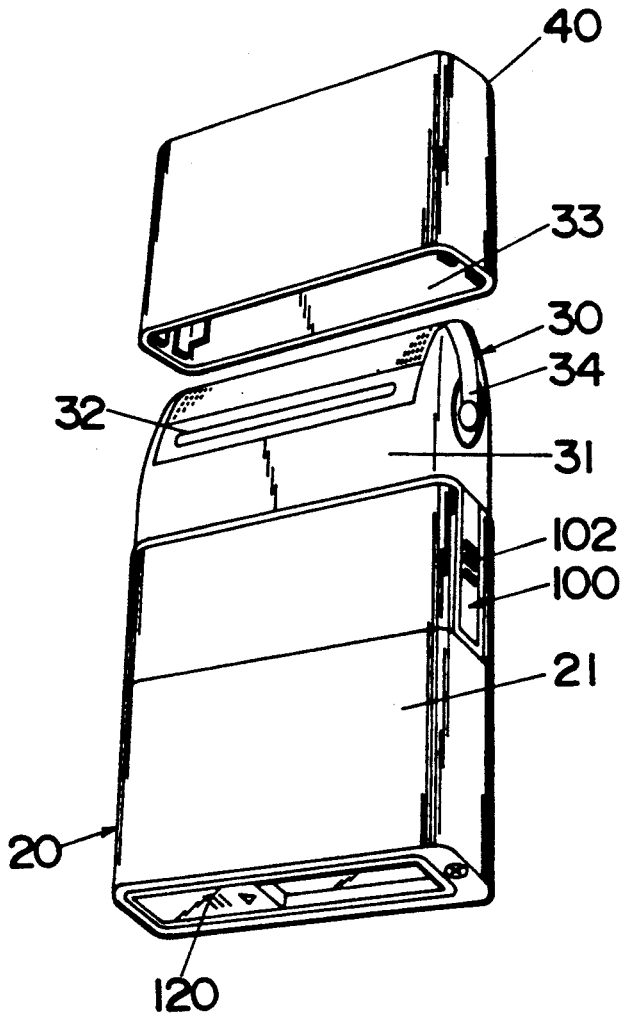
FIG. 2 is a perspective view of the dry shaver with a head cap detached.

Referring now to FIGS. 1 and 2, there is shown a flat-shaped battery powered dry shaver in accordance with a preferred embodiment of the present invention. The dry shaver includes a casing 20 mounting a flat cutter head 30 of reciprocatory type. A head cap 40 is fitted over the cutter head 30 and is cooperative therewith to present a credit card size planar configuration with a reduced thickness as small as 12 mm. That is, the dry shaver is dimensioned to have a length of 89 mm, a width of 54 mm, and a thickness of 12 mm so as to be completely portable. The head cap 40 is configured to have its lower end in flush with the upper end of the casing edge so as to be continuous with the casing 20.

As shown in FIGS. 3 to 6, the cutter head 30 includes a head frame 31 secured to the upper end of the casing 20 for detachably supporting a cartridge 32 carrying a curved outer shear foil 33. Also included in the cutter head 30 is an inner cutter assembly 35 carrying a number of inner blades curved in conformity with the inner curved surface of the outer shear foil 33. The inner cutter assembly 35 is disposed within the head frame 31 and is operatively connected to an electric motor 50 through a pivot lever 60, a drive arm 70, and an eccentric pin 56 so that it is driven thereby to reciprocate in hair shearing engagement with the outer shear foil 33. The head cap 40 includes an inner holder 41 made of plastic which is secured by an adhesive sheet or tape 42 to the interior of the head cap 40 to fit over the outer shear foil 33. The inner holder 41 is formed in its opposed legs respectively with slots 43 for slidable engagement with knobs 34 on the opposite side of the cartridge 32 so as to smoothly guide the head cap 40 onto the cutter head 30.

Figure 3:
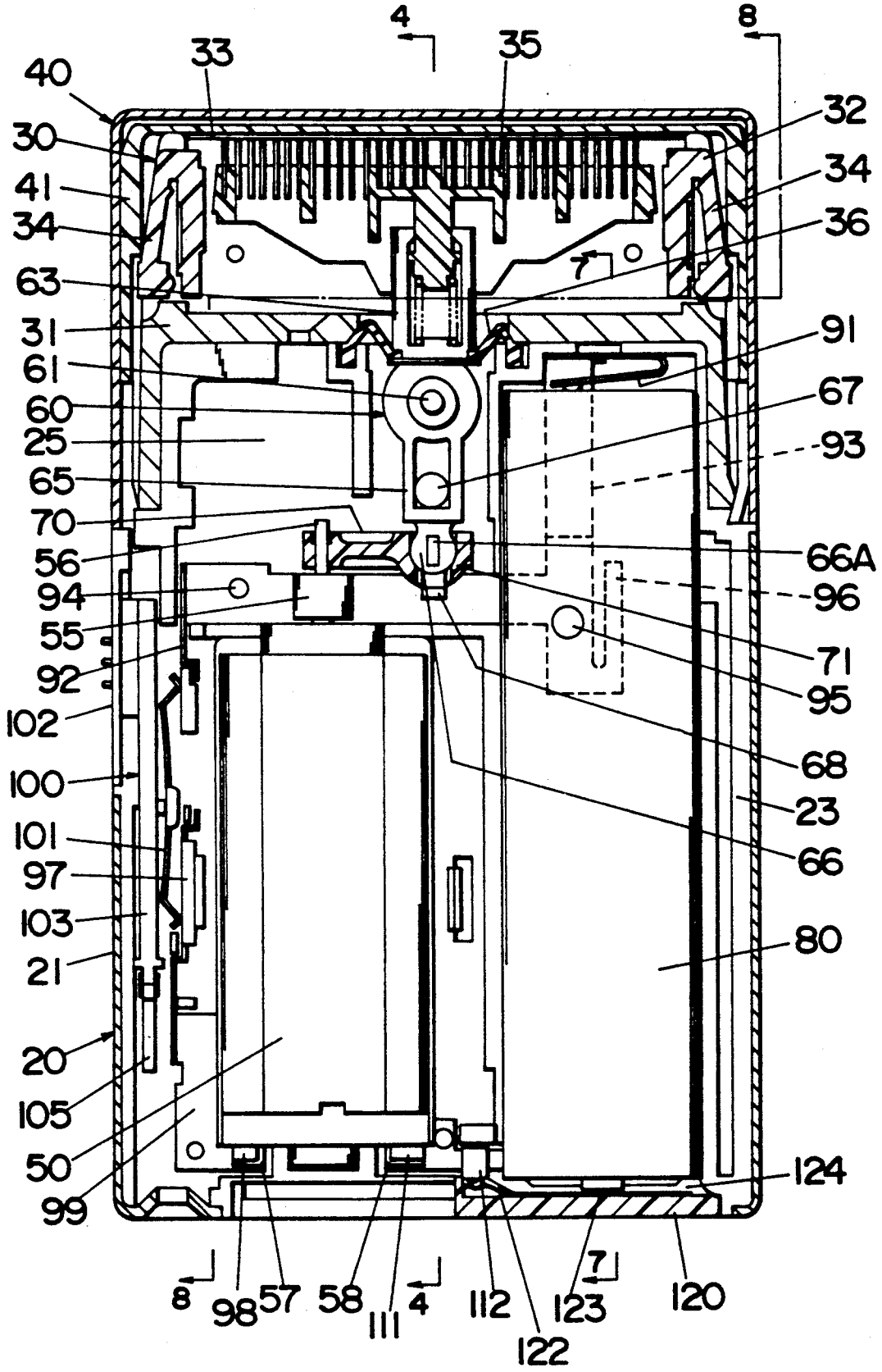
FIG. 3 is a sectional front view of the dry shaver.
Figure 4:
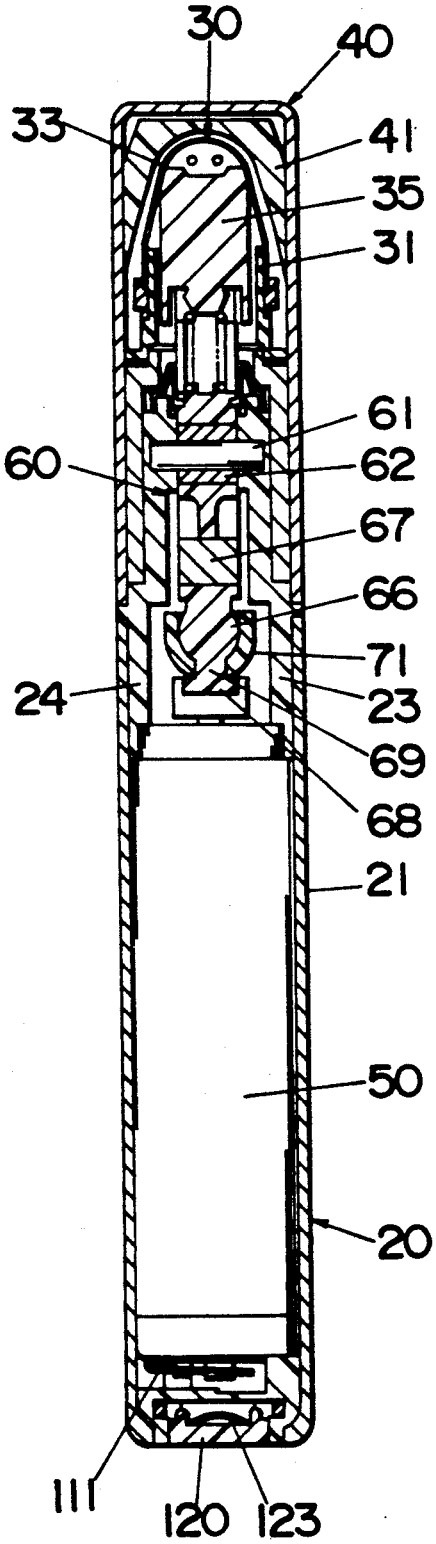
FIG. 4 is a sectional side view taken along line 4—4 of FIG. 3 with a bottom battery lid slid into an open position.

The casing 20 comprises a thin flat sheath 21 fitted over a housing composed of a pair of opposed housing halves 23 and 24. The housing is of generally rectangular configuration with a reduced thickness to form therein a correspondingly rectangular inner room for receiving therein the motor 50, the lower half of the pivot lever 60, the drive arm 70, and a rechargeable battery 80 energizing the motor 50. The upper end of the housing projects beyond the upper end of the sheath 21 to form thereat a head projection 28 receiving thereon the head frame 31. The battery 70 is of a flat and elongated Configuration with a thickness less than that of the motor 50 and is disposed within the housing to extend along one lateral side of the housing over the full length thereof, as best shown in FIG. 3. The motor 50, which is also of flat configuration having a thickness as near as that of the housing and therefore that of the cutter head 30, is disposed in side-by-side relation to the battery 80 to extend along the other lateral side of the housing with its lower end in substantially the same level as the lower end of the battery 50. The motor 50 is selected to have a length less than that of the battery 80 so as to define thereabove a free space 25 which extends between the top portion of the battery 80 and the opposed side of the housing and includes the upper center portion of the housing. It is within this free space 25 that the lower portion of the pivot lever 60, the drive arm 70, and the eccentric pin 56 are accommodated for establishing a driving connection from the motor 50 to the reciprocating inner cutter assembly 35. The housing halves 23 and 24 are formed respectively with openings 26 and 27 which are in registration with each other to form a through-hole for receiving therein the full-thickness of the motor 50, as shown in FIG. 4. In other words, housing can be configured to have a reduced thickness as little as that of the motor 50, while successfully accommodating the motor 50 together with the battery 80 of which the thickness is less than that of the motor 50.

Figure 5:
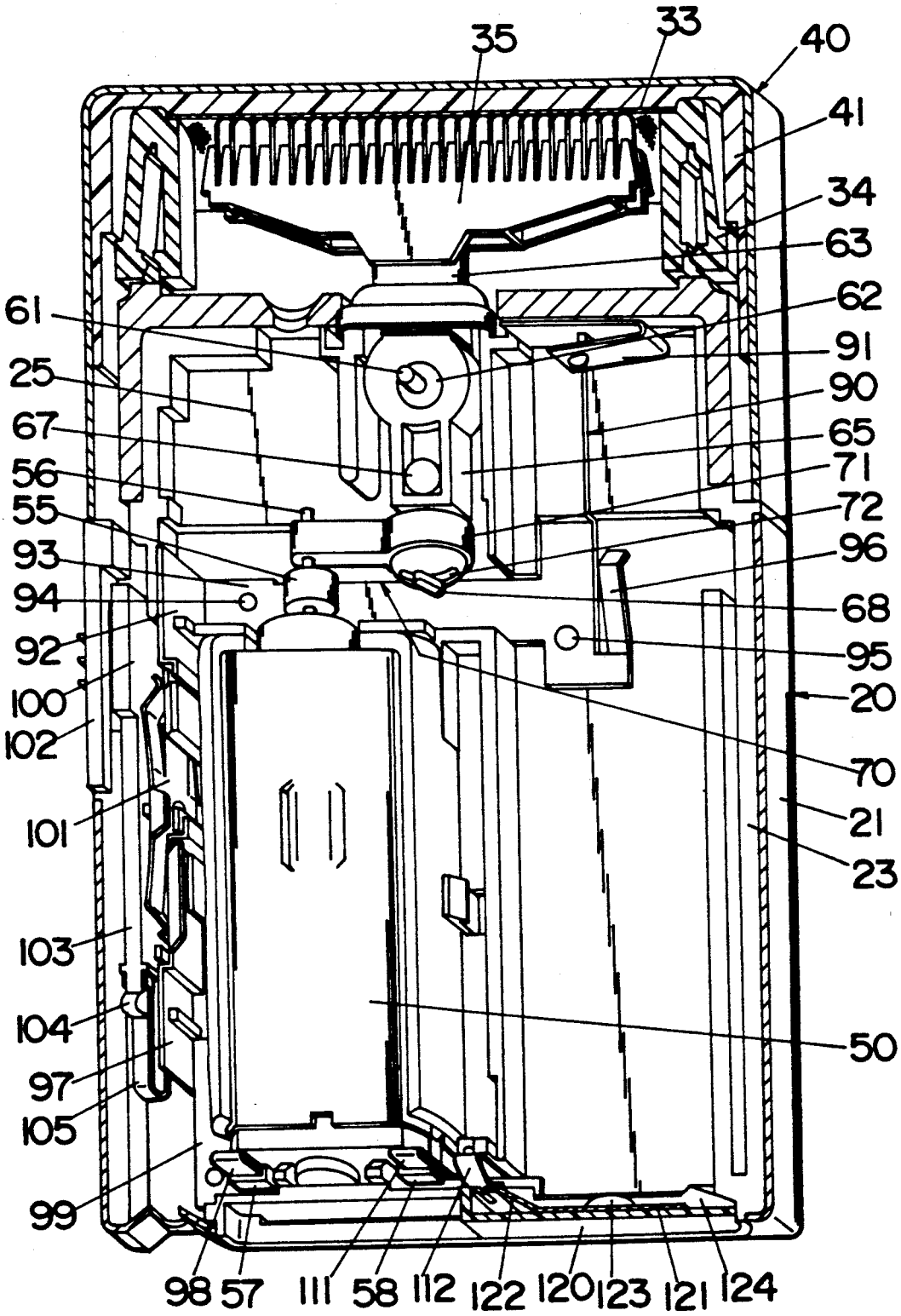
FIG. 5 is a perspective view of the dry shaver with a housing half removed for illustration thereof in correspondence to FIG. 3.
Figure 6:
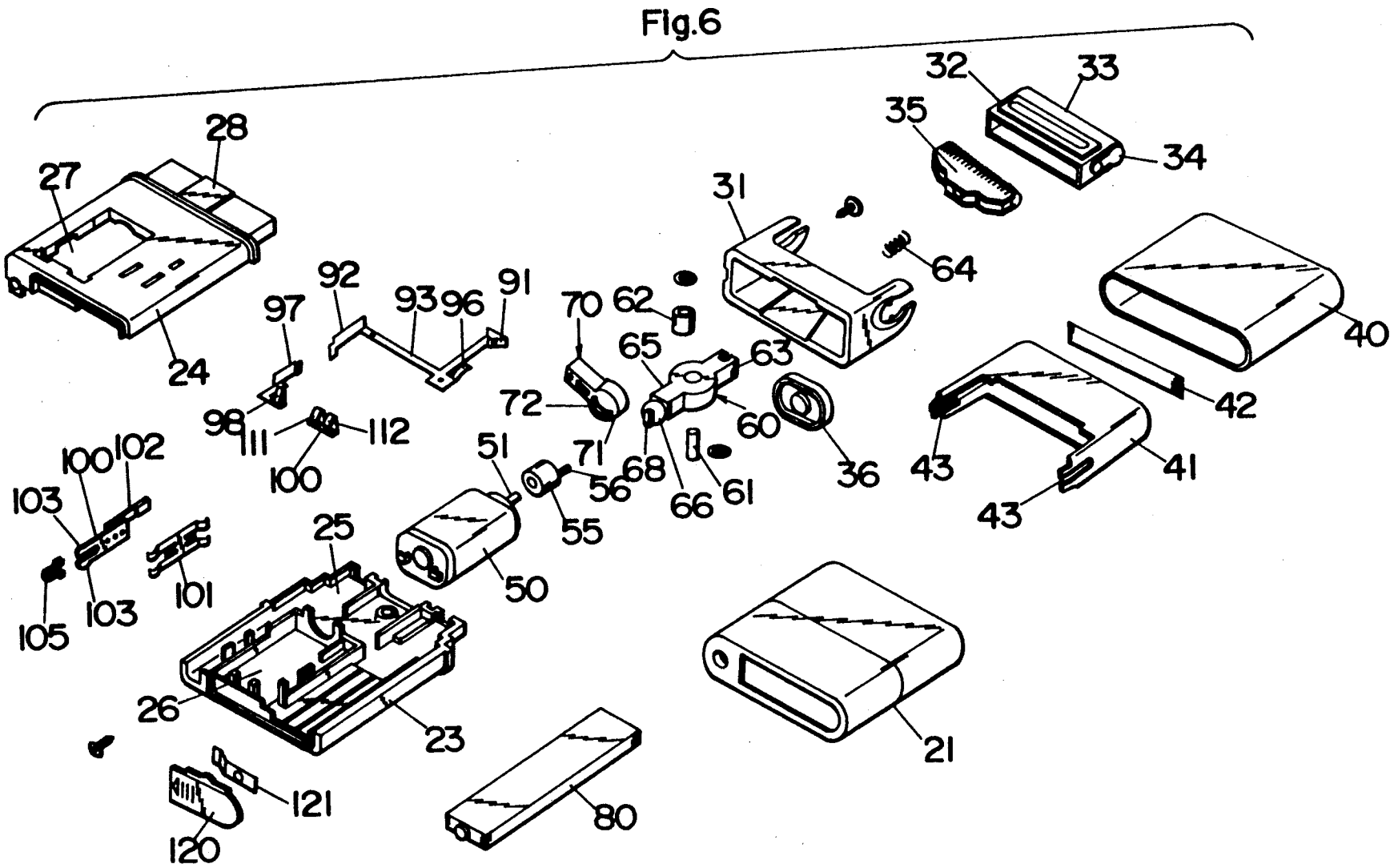
FIG. 6 is a fully exploded perspective view of the dry shaver.
Figure 7:
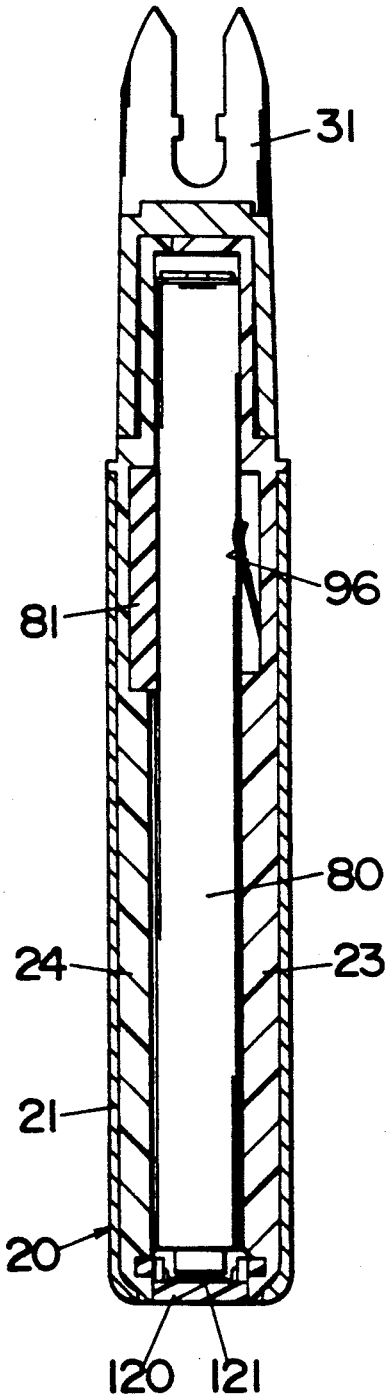
FIG. 7 is a sectional side view taken along line 7—7 of FIG. 3.

The pivot lever 60 is pivoted intermediate its ends by a pivot pin 61 to the upper center end of the housing within the space 25 with its upper segment 63 projecting into the head frame 31 for detachable pivot connection with the bottom center of the inner cutter assembly 35. The upper segment 63 of the pivot lever 60 includes a coil spring 64 biasing the inner blade assembly against the outer shear foil 33. A seal rubber 36 surrounds the upper segment 63 of the pivot lever 60 to prevent the entry of the clipped hair into the housing. A metal bearing 62 is fitted around the pivot pin 61. A lower segment 65 of the pivot lever 60 extends into the space 25 and is formed at its lower end with a ball 66 for coupling with the drive arm 70. A balancing weight 67 is held in the lower segment 65 adjacent upwardly of the ball 66 for counterbalancing the reciprocating movement of the inner cutter assembly 35. A fastener tag 68 extends from the lower end of the ball 66 integrally through a stem 69 for easy coupling with the drive arm 70, as discussed below. The drive arm 70 extends horizontally within the space 25 with its one end connected to the eccentric pin 56. The other end of the drive arm 70 is formed with a half-spherical socket 71 into which the ball 66 at the lower end of the pivot lever 60 engages for ball-joint coupling therebetween, as shown in FIGS. 3 and 5. The eccentric pin 56 projects in an eccentric relation to a motor output shaft 51 through a balancer 55 fixed to the output shaft 51 in an concentric relation thereto. Thus, the drive arm 70 is driven to reciprocate horizontally within the space 25 upon eccentric rotation of the eccentric pin 56, thereby causing the pivot lever 60 to pivot about the pivot pin 61 so as to reciprocate the inner cutter assembly 35 in a direction parallel to the drive arm 70. During the reciprocatory movement of the inner cutter assembly 35, the ball-joint coupling between the ball 66 and the socket allows escape of the movement of the ball 66 relative to the socket 71 in the directions Other than the lateral reciprocating directions, thereby successively reciprocating the inner cutter assembly 35 in hair shearing engagement with the outer shear foil 33. The socket 71 is formed in its bottom with a slot 72 through which the fastener tag 68 of the pivot lever 60 is permitted to extend such that the drive arm 70 can be easily assembled to the pivot lever 60 simply by extending the fastener tag 68 through the slot 72 and then rotating the pivot lever 60 by an extent of about 90° about is longitudinal axis. It is noted here that the ball 66 at the end of the pivot lever 60 is cut partially in its spherical surface to form a flat surface 66A which defines with the corresponding portion of the socket 71 a small reservoir for retaining a lubricant oil.

Figure 8:
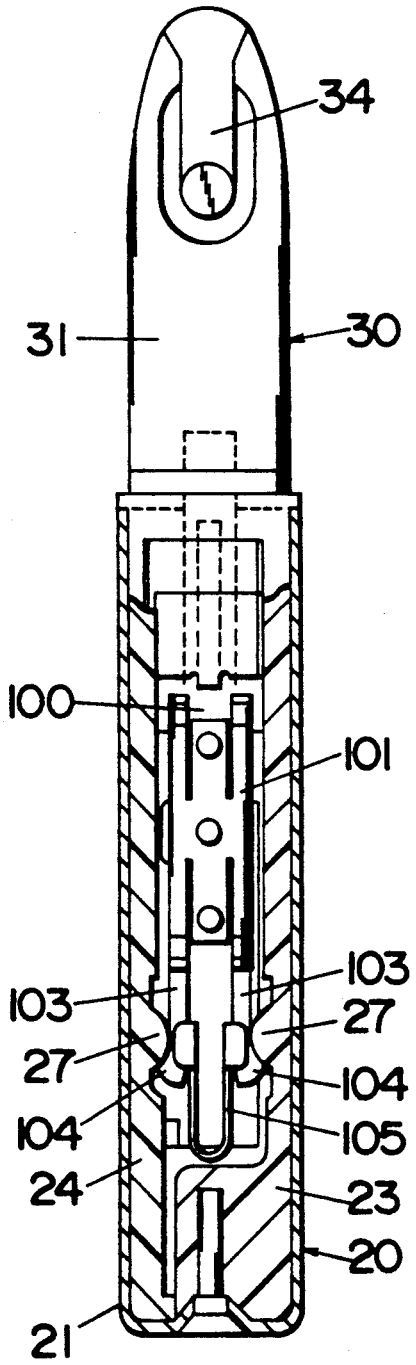
FIG. 8 is a sectional side view taken along line 8—8 of FIG. 3.
Figure 9:
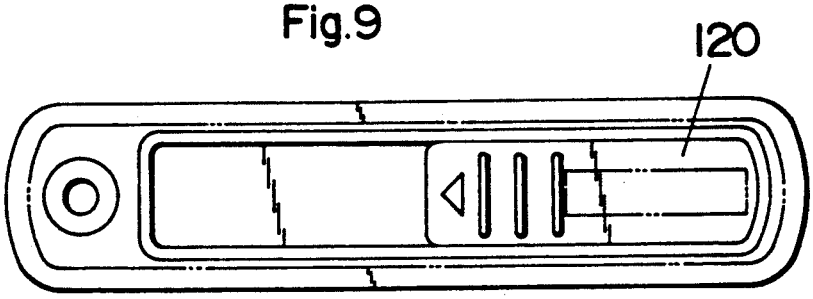
FIG. 9 is a bottom view of the dry shaver.
Figure 10:
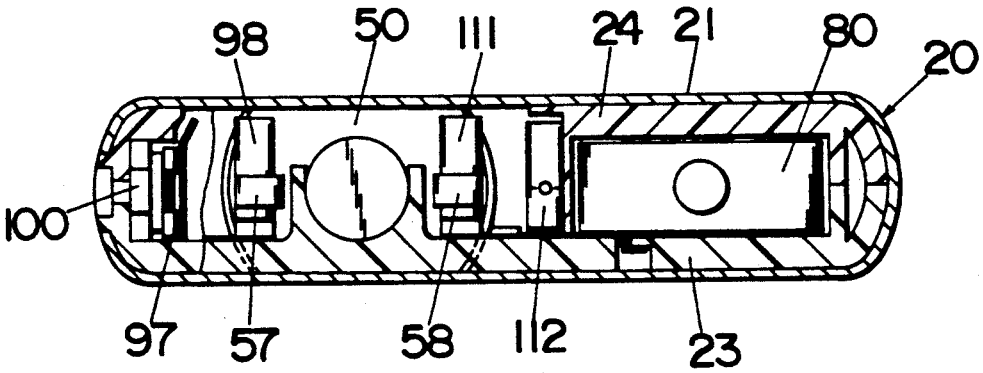
FIG. 10 is a sectional bottom view of the dry shaver.
Figure 11:
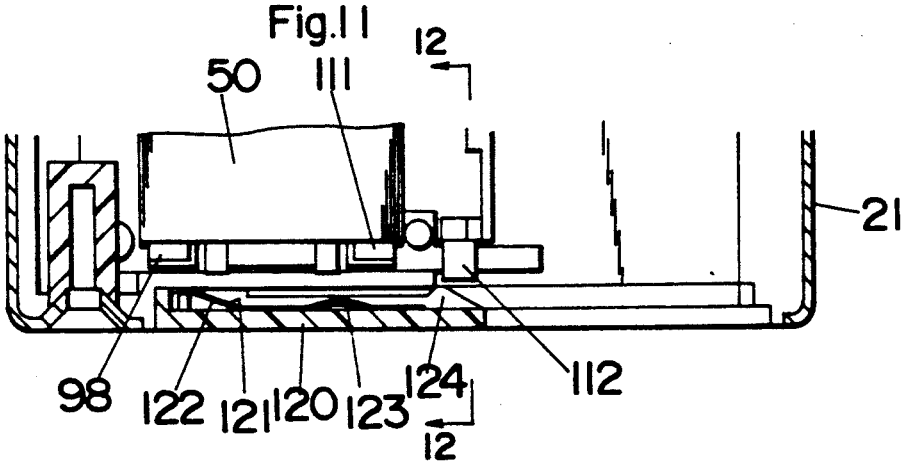
FIG. 11 is a sectional front view of a bottom portion of the dry shaver.
Figure 12:
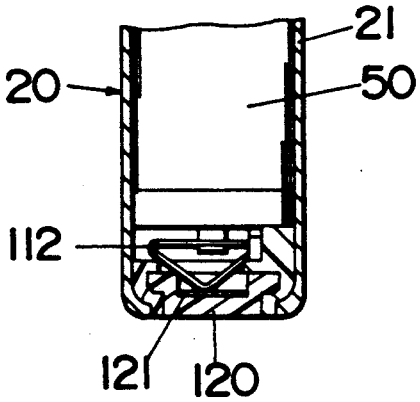

The housing includes a terminal spring 90 which is struck from a single metal sheet to have a terminal contact 91 for electrical connection with an upper negative electrode of the battery 80, a first switch contact 92, and a bus 93 for interconnection therebetween. As shown in FIGS. 3 and 5, the bus 93 extends along the interior surface of the housing half 23 and secured thereto at 94 and 95 and is also formed with an integrally bent spring leg 96 which is in pressed contact with the battery 80 for urging it against an elastic member 81 held in the opposed housing half 24, thereby securely holding the battery 80 between the spring leg 96 and the elastic member 81. The first switch contact 92 is cooperative with a second switch contact 97 and a movable contact 101 to form a power switch for energization and deenergization of the motor 50. The first and second switch contacts 92 and 97 are located within an vertically elongated space between the motor 50 and the adjacent housing side to be bridged by the movable contact 101 carried on a switch handle 100 which is vertically slidable in that space with its operator knob 102 projecting on the side of the housing. The second switch contact 97 is also struck from a single metal sheet to integrally form a U-shaped bent lug 98 for direct electrical connection with one motor terminal 57 and is secured to the housing half 23 at a web 99 connecting the second switch contact 97 and the lug 98. The other motor terminal 58 is connected to a like U-shaped bent lug 111 of a terminal 110 which is electrically connected to the lower positive electrode of the battery 80 through a conductor 121 on a battery lid 120 slidable along the bottom of the housing. The switch handle 100 is a two-position selector having an upper ON-position in which the movable contact 101 connects the first and second switch contacts 92 and 97 for energizing the motor 50 and a lower OFF-position in which the movable contact 101 is disengaged from the first switch contact 92 for deenergizing the motor 50. The switch handle 100 is integrally formed with a pair of depending opposed legs 103 with latch projections 104 at their respective lower ends. A U-shaped spring 105 is interposed between the legs 103 for urging them to expand outwardly such that the latch projections 104 come into latching engagement into recesses formed on the opposite side of round projections 27 on the respective housing halves 23 and 24, as shown in FIG. 8, thereby holding the switch handle 100 in both of the ON- and OFF-positions, while allowing the legs 103 to flex inwardly as the latch projections 104 ride over the rounded projections 27 in response to the sliding movement of the switch handle 100.

The battery lid 120 is slidably supported in the bottom of the housing with its side edges engaged into corresponding grooves in the housing halves 23 and 24 to move from an open position of opening a bottom opening of the housing provided for access to the battery 80 to a closed position of closing the bottom opening. The conductor 121 held on the battery lid 120 has an inclined tab 122 which comes into pressed contact with a spring contact 112 formed integrally with the U-shaped leg 111 in direct electrical contact with the motor terminal 58 when the lid 120 is in the closed position, as shown in FIGS. 3 and 5. At this position, a bump 123 on the center of the conductor 121 is in abutment with the positive electrode of the battery 80 for completing the electrical connection from the positive electrode of the battery 80 to the one terminal of the motor 50. The lid 120 is provided at its leading end with a pair of triangular pilot extensions 124 which are laterally spaced so as not to come into conflict with the positive electrode of the battery 80 during the sliding movement between the open and closed positions. When the lid 120 is moved from the open position to the closed position, the pilot extensions 124 are first to come into contact with the lower corner of the battery 80 to thereby push it inwardly against the bias of the terminal contact 91, enabling the smooth closure of the lid 120 without being jammed with the downwardly biased battery 80, after which the positive electrode of the battery so is biased into pressed contact With the bump 123 of the conductor 121. The lid 120 is latched into either of the open and closed positions by engagement of latch projections (not seen) to the corresponding recesses (also not seen) in the bottom of the housing.

What is claimed is:

1. A dry shaver comprising:

a flat casing mounting a flat cutter head, said flat casing being of generally rectangular configuration with reduced thickness, said cutter head comprising an outer shear foil and an inner cutter assembly driven to reciprocate in hair shearing engagement with said outer shear foil;

a flat and elongated battery disposed within said casing to extend along one lateral side thereof over substantially the entire length of said casing;

a flat motor energized by said battery to drive said inner cutter assembly, said flat motor disposed within said casing in side-by-side relation to said battery to extend along the other lateral side thereof with the lower end of the motor substantially aligned with the lower end of said battery, said flat motor having a length shorter than said battery to form above said flat motor a space which extends transversely across said casing from the side of said casing which is adjacent said motor into an upper center portion of said casing, said flat motor having an output rotor shaft extending upwardly for coupling with an eccentric shaft within said space;

a pivot lever extending generally longitudinally of said casing and having a first end and a second end, means pivotally supporting said pivot lever at a portion intermediate said first and second ends to the upper center of said casing with said first end extending outwardly of said casing for coupling with said inner cutter assembly, said second end extending downwardly into a lower portion of said space; and a drive arm extending generally transversely within said space from said eccentric shaft to the second end of said pivot lever and connected to reciprocate said pivot lever about a pivot axis upon rotation of said eccentric shaft, thereby driving to reciprocate said inner cutter assembly;

wherein said motor has a thickness greater than said battery, said casing comprising a housing and a sheath fitted closely over said housing, said housing comprising a pair of housing halves between which said battery is sandwiched, said housing halves formed respectively with opposed openings which cooperate to define a through-hole for receiving therein the entire thickness of said motor such that said housing has a minimum thickness substantially equal to that of said motor.

2. A dry shaver as set forth in claim 1, wherein said housing includes a terminal spring having a contact end for electrical connection with one electrode of said battery, said terminal spring being integrally formed with a spring leg which is disposed on the interior surface of one of said housing halves in contact with the said battery for urging it against the interior surface of the other housing half.

3. A dry shaver as set forth in claim 1, further including a head cap fitted over said cutter head, said head cap being of flat configuration so as to be in continuous with said sheath, said head cap being cooperative with said sheath to give a credit card size planar configuration to said dry shaver.

4. A dry shaver as set forth in claim 1 wherein said motor has a width greater than said battery.

5. A dry shaver as set forth in claim 1 wherein said output rotor shaft has a balancer affixed thereto and said second end of said pivot lever has a balancing weight affixed thereto.

6. A dry shaver comprising:

a flat casing mounting a flat cutter head, said flat casing being of generally rectangular configuration with reduced thickness, said cutter head comprising an outer shear foil and an inner cutter assembly driven to reciprocate in hair shearing engagement with said outer shear foil;

a flat and elongated battery disposed within said casing to extend along one lateral side thereof over substantially the entire length of said casing;

a flat motor energized by said battery to drive said inner cutter assembly, said flat motor disposed within said casing in side-by-side relation to said battery to extend along the other lateral side thereof with the lower end of the motor substantially aligned with the lower end of said battery, said flat motor having a length shorter than said battery to form above said flat motor a space which extends transversely across said casing from the side of said casing which is adjacent said motor into an upper center portion of said casing, said flat motor having an output rotor shaft extending upwardly for coupling with an eccentric shaft within said space;

a pivot lever extending generally longitudinally of said casing and having a first end and a second end, means pivotally supporting said pivot lever at a portion intermediate said first and second ends to the upper center of said casing with said first end extending outwardly of said casing for coupling with said inner cutter assembly, said second end extending downwardly into a lower portion of said space; and a drive arm extending generally transversely within said space from said eccentric shaft to the second end of said pivot lever and connected to reciprocate said pivot lever about a pivot axis upon rotation of said eccentric shaft, thereby driving to reciprocate said inner cutter assembly;

wherein said drive arm is coupled to said pivot lever through a ball-joint.

7. A dry shaver as set forth in claim 6, wherein said housing includes a terminal spring having a contact end for electrical connection with one electrode of said battery, said terminal spring being integrally formed with a spring leg which is disposed on the interior surface of one of said housing halves in contact with the said battery for urging it against the interior surface of the other housing half.

8. A dry shaver as set forth in claim 6, further including a head cap fitted over said cutter head, said head cap being of flat configuration so as to be continuous with said sheath, said head cap cooperating with said sheath to give a credit card size planar configuration to said dry shaver.

9. A dry shaver as set forth in claim 6, wherein the pivot lever has at its lower end a ball which is fitted within a correspondingly shaped socket to form the ball joint; said ball being provided with a fastener tag in the form of an elongated projection which is allowed to extend through and past a correspondingly shaped slot formed in the bottom of said socket; said ball being turned within said fastener to lockingly engage with the exterior surface of said socket.

10. A dry shaver as set forth in claim 6 wherein said motor has a width greater than said battery.

11. A dry shaver as set forth in claim 6 wherein said output rotor shaft has a balancer affixed thereto and said second end of said pivot lever has a balancing weight affixed thereto.

12. A dry shaver comprising:

a flat casing mounting a flat cutter head;

a flat and elongated battery disposed within said casing;

a flat motor energized by said battery;

a pivot lever extending generally longitudinally of said casing and having a first end and a second end; and a drive arm extending generally transversely within a space extending transversely across said casing from a side if said casing which is adjacent to said motor into an upper center portion of said casing;

said motor having a thickness greater than said battery, said casing comprising a housing and a sheath fitted closely over said housing, said housing comprising a pair of housing halves between which said battery is sandwiched, said housing halves formed respectively with opposed openings which cooperate to define a through-hole for receiving therein the entire thickness of said motor such that said housing has a minimum thickness substantially equal to that of said motor.

13. A dry shave as set forth in claim 12, wherein:

said flat casing is of generally rectangular configuration with a reduced thickness, said cutter had comprising an outer shear foil and an inner cutter assembly driven to reciprocate in hair shearing engagement with said outer shear foil;

said battery extending along one lateral side thereof over substantially the entire length of said casing;

said motor driving said inner cutter assembly and disposed within said casing in side-by-side relation to said battery to extend along the other lateral side thereof with the lower end of the motor substantially aligned with the lower end of said battery, said motor having a length shorter than said battery to form said space, said motor having an output rotor shaft extending upwardly for coupling with an eccentric shaft within said space;

said pivot lever being supported by pivotal support means for supporting said pivot lever at a portion intermediate said first and second ends to the upper center of said casing with said first end extending outwardly of said casing for coupling with said inner cutter assembly, said second end extending downwardly into a lower portion of said space; and said drive arm extending generally transversely within said space from said eccentric shaft to the second end of said pivot lever and connected to reciprocate said pivot lever about a pivot axis upon rotation of said eccentric shaft, thereby driving to reciprocate said inner cutter assembly.

14. A dry shaver as set forth in claim 13, wherein said housing includes a terminal spring having a contact end for electrical connection with one electrode of said battery, said terminal spring being integrally formed with a spring leg which is disposed on the interior surface of one of said housing halves in contact with the said battery for urging it against the interior surface of the other housing half.

15. A dry shaver as set forth in claim 13, further including a head cap fitted over said cutter head, said head cap being of flat configuration so as to be continuous with said sheath, said head cap cooperating with said sheath to give a credit card size planar configuration to said dry shaver.

16. A dry shaver as set forth in claim 13 wherein said motor has a width greater than said battery.

17. A dry shaver as set forth in claim 13 wherein said output rotor shaft has a balancer affixed thereto and said second end of said pivot lever has a balancing weight affixed thereto.

* * * * *